US006932343B1

(12) United States Patent
Miller

(10) Patent No.: US 6,932,343 B1
(45) Date of Patent: Aug. 23, 2005

(54) BONUS CARD GAME METHOD

(76) Inventor: Gary Miller, 3655 Rawhide Ct., Las Vegas, NV (US) 89120

( * ) Notice: Subject to any disclaimer, the term of this patent is extended or adjusted under 35 U.S.C. 154(b) by 15 days.

(21) Appl. No.: 10/345,907

(22) Filed: May 14, 2003

Related U.S. Application Data

(60) Provisional application No. 60/349,923, filed on Jan. 17, 2002.

(51) Int. Cl.[7] ..... A63F 1/00
(52) U.S. Cl. ..... 273/292; 273/274; 273/303; 273/293; 463/11; 463/12; 463/13
(58) Field of Search ..... 273/292–293, 273/303, 274; 463/11–13

(56) References Cited

U.S. PATENT DOCUMENTS 5,098,107 A * 3/1992 Boylan et al. ..... 273/292
5,282,633 A * 2/1994 Boylan et al. ..... 273/306
5,308,065 A * 5/1994 Bridgeman et al. ..... 463/13
5,653,444 A * 8/1997 Dahl ..... 273/274
5,685,774 A * 11/1997 Webb ..... 463/13
5,743,800 A * 4/1998 Huard et al. ..... 463/26
5,947,821 A * 9/1999 Stone ..... 463/13
6,036,190 A 3/2000 Edmunds et al.
6,056,641 A 5/2000 Webb
6,146,270 A * 11/2000 Huard et al. ..... 463/12
6,193,235 B1 * 2/2001 Vancura et al. ..... 273/292
6,311,976 B1 * 11/2001 Yoseloff et al. ..... 273/138.2
6,461,240 B1 * 10/2002 Perkins ..... 463/13
6,494,454 B2 12/2002 Adams
2001/0034264 A1 * 10/2001 Berman et al. ..... 463/22

* cited by examiner

*Primary Examiner*—Gregory Vidovich
*Assistant Examiner*—Dolores Collins
(74) *Attorney, Agent, or Firm*—Robert Ryan Morishita; Anderson & Morishita, LLC

(57) ABSTRACT

One or more payout indicia cards are randomly interspersed throughout a conventional deck of cards. A base game begins with players wagering and receiving a player hand. During game play of the base game, players receiving a payout indicia card are rewarded as indicated by the payout indicia card rather than the payout under the base rules. Outcome indicia cards may also be included in the deck of cards. The outcome for players receiving outcome is changed to the outcome indicated on the outcome indicia card rather than the outcome under the base rules. The method may also be applied to games utilizing electronic representations of playing cards.

9 Claims, 1 Drawing Sheet

BONUS CARD GAME METHOD

RELATED APPLICATION DATA

The present application claims the priority of U.S. Provisional Application Ser. No. 60/349,923 entitled "Bonus Card Game Method," filed Jan. 17, 2002 by Applicant herein.

FIELD OF THE INVENTION

The present invention relates to gaming methods. Specifically, the present invention is a method for modifying a casino card game, such as Blackjack, to include a bonus reward system based on supplemental cards added to a deck of cards used for game play.

BACKGROUND OF THE INVENTION

Many casino games include players playing against the casino to obtain a player hand having a value closer to a target value than the house hand. For example, Baccarat, Blackjack, Spanish Twenty-One, and the like all fit this pattern.

Blackjack is a well known card game played in casinos. The object of the game is to have a final hand total closer to twenty-one than the dealer's hand without exceeding twenty-one. For purposes of calculating the final hand total, each card has a value equal to its face value except face cards, which have a value of ten, and aces, which may have a value of eleven or one as the player selects or as required to prevent the player from exceeding twenty-one. In conventional Blackjack, the suit of the cards is not relevant to the outcome of the game.

The form of Blackjack played in casinos is played between a dealer, representing the house, and at least one player. In a typical Blackjack game, each player makes a wager in a wagering area on a playing surface. The dealer deals two cards to each player and two cards, one card face up and the other face down, to himself or herself. Any player receiving a natural twenty-one or Blackjack, i.e. a total of twenty-one in the initial dealt hand, is immediately rewarded, typically at a rate of 2:1 or 3:2, and play is terminated as to that player. Each remaining player examines his or her hand and decides whether to hit, i.e. receive another card, or stand, i.e. receive no further cards and finish play with the player's current hand. A player may hit as many times as the player wishes as long as the player does not bust, i.e. have a cumulative total greater than twenty-one. When a player busts, that player's wager is immediately collected and play is terminated as to that player.

A player may also have additional options available depending on the initial hand dealt and the house rules. For example, a player may have the option of "doubling down." Although the availability of the double down option varies depending on each casino's house rules, the option allows a player to double the player's wager in exchange for a single additional card. Some house rules permit doubling down on initial hand totals of ten or eleven only, other house rules permit doubling down on any initial hand total.

Another option available to a player is the option of "splitting." If a player receives a pair, i.e. two cards having the same face value, in his initial hand, most house rules permit the player to split the pair and use each card as a basis for a separate hand. For example, if a player is dealt a pair of eights, the player may choose to split the pair and continue play with two hands each having an eight and an additional dealt card as an initial hand. Each of those individual hands is then played independently by hitting, standing, or, under some house rules, doubling down or further splitting.

After all the players have played their hands, the dealer reveals the face-down card in the dealer's hand and completes the dealer's hand according to established house rules. That is, the casino uses established rules to eliminate the dealer's discretion. The dealer hits or stands as the house rules dictate, and resolves the wagers. In resolving the wagers, players with a final hand total closer to twenty-one than the dealer's final hand total are rewarded at even money. Conversely, wagers are collected from players with a final hand total further from twenty-one than the dealer's final hand total. If the dealer busts, all players who did not bust or receive a Blackjack are rewarded at even money. If the player and dealer push, i.e. have the same final hand total, the player's wager is returned.

One drawback to conventional Blackjack is that the payouts are small compared to other games. In conventional Blackjack, the greatest payout a player can expect is 2:1 or 3:2 for a natural twenty-one or Blackjack. One method devised to address this drawback and increase the excitement and potential win for Blackjack players is for the player to make an additional wager to participate in a bonus feature.

For example, U.S. Pat. No. 5,839,730, issued to Pike, discloses a side wager for Blackjack in which players are immediately rewarded for obtaining card sequences independent and separate from the Blackjack game. The winning bonus sequence may include only two cards, such as a pair of cards or consecutive cards, or it may include multiple cards. The player may earn a bonus reward even if he or she loses the Blackjack game itself.

However, the game of Pike has drawbacks. First, participation in the bonus of Pike requires a player to make a supplemental wager. Such a requirement is likely to reduce participation and make bonus payouts infrequent.

Also, when a player chooses to participate in the bonus of Pike, the player must designate a specific bonus outcome and will only be rewarded if the correct bonus outcome occurs. In other words, a player participating in the bonus of Pike must place a supplemental wager to become eligible for a bonus payout and also designate which bonus payout he or she expects, such as a pair, a straight, a flush, or the like. The player is only rewarded on the bonus wager if he or she designates the correct bonus outcome; thus, a player who places his or her bonus wager on a pair but receives a straight will not be rewarded.

Another drawback of Pike is that the bonus game and the Blackjack game are independent from one another. Thus, a player may become eligible for a bonus payout at any point during game play and, in fact, without regard to whether the player wins or loses the Blackjack game itself. For example, if a player places a bonus wager on a straight and receives a seven and an eight, he may be rewarded on the bonus wager. However, if the player hits and busts, he loses the base Blackjack game even though he or she won, and will be rewarded on, the bonus wager. Attempting to keep all the payouts and wagers straight can be confusing for the dealer and player alike and can slow game play and lead to mistakes in payouts.

A similar Blackjack bonus game is disclosed in U.S. Pat. No. 5,288,077 to Jones. Jones '077 discloses a side wager for blackjack in which players receive a progressive jackpot reward for receiving a variety of hands including straights, suited combinations, and the like. U.S. Pat. No. 5,577,731, also to Jones, likewise discloses a side wager for Blackjack in which players receive a progressive jackpot reward for receiving three aces during the play of the player's hand. The drawbacks to Jones '077 and Jones '731 are the player must, once again, make a side wager to become eligible for the progressive jackpot and that the progressive payouts must be tracked by the dealer and carried over to each successive game. Again, this can be a burden on the dealer and reduce his or her efficiency and number of games dealt per time period.

Yet another bonus scheme is disclosed in Lofink, U.S. Pat. No. 5,615,888. Lofink discloses a game in which a bonus is paid for receiving various combinations of cards that add to twenty-one, such as three sevens, three suited sevens, six-seven-eight, and so forth. However, bonus payouts will be infrequent in such a bonus scheme because the only bonus combinations disclosed add to twenty-one. Also, there is no added excitement for the player because a sum of twenty-one already guarantees the player at least a push.

Thus, it can be seen that there is a need in the art for a modified card game method based on well known games such as Blackjack that provides for large payouts tied to the outcome of the base game with or without the need for side wagers.

SUMMARY OF THE INVENTION

The present invention is a modification to a base card game such as Blackjack. It should be noted that the present method could optionally be used in conjunction with many different base games including Blackjack, Baccarat, Spanish 21, and the like. It should also be noted that the present method could be applied to a live table game or an electronic, mechanical, electromechanical, or video game. According to the method of the present invention, at least one indicia card is randomly shuffled into a deck of cards used in the base game. In an embodiment for Blackjack, for example, the indicia card or cards would be randomly placed into a conventional deck of cards or conventional shoe containing multiple decks of cards. The indicia cards have no value in the base game.

The indicia cards could take many forms. In one optional embodiment, the indicia cards have the appearance of conventional playing card backs but include indicia on their faces. In an alternate optional embodiment, the card back includes an indicia on all or a portion of the card back. The indicia could indicate any of a variety of payouts including flat payout amounts, payout multipliers, non-cash prizes or changes in outcome. That is, indicia could take the form of payout indicia cards or outcome indicia cards. It is contemplated that players may always be entitled to the benefit of indicia cards or only when a side wager has been made. It is also contemplated that the indicia could apply only to the player receiving the indicia card or to all those participating in the base game. It is further contemplated that an outcome indicia card could be used to alter the outcome from that under the base rules. For example, a "Push" indicia card could optionally be provided for use by a player to retain a base wager even if the player has a losing outcome.

The game of the present invention begins as with the base game played according to base rules. In most base games, players place base wagers and receive a hand of cards. If a player hand includes an indicia card, the indicia card is treated as if it has no value other than to affect the eventual payout and is replaced during game play with a playing card. Play of the base game continues according to the base rules. A player with an indicia card is treated according to the indicia card rather than according to the base rules. Again, the indicia card could be a payout indicia card that directs a payout different than that under the base rules, or an outcome indicia card that directs a different outcome than that under the base rules. In an optional embodiment, the player must win to be eligible for the payout of the payout indicia card. If multiple payout indicia cards are received, payouts may be restricted to only one card or the payouts may be cumulative or multiplicative. In one optional embodiment, all winning wagers are rewarded according to the payout indicia card if even only one player received the payout indicia card.

A further embodiment may include an outcome indicia card. In an optional embodiment including a "Push" card, a player with a losing outcome holding "Push" card will retain his or her base wager.

As noted above, the present method could be embodied in an electrical, mechanical, or electromechanical gaming device.

DESCRIPTION

Figure 1:
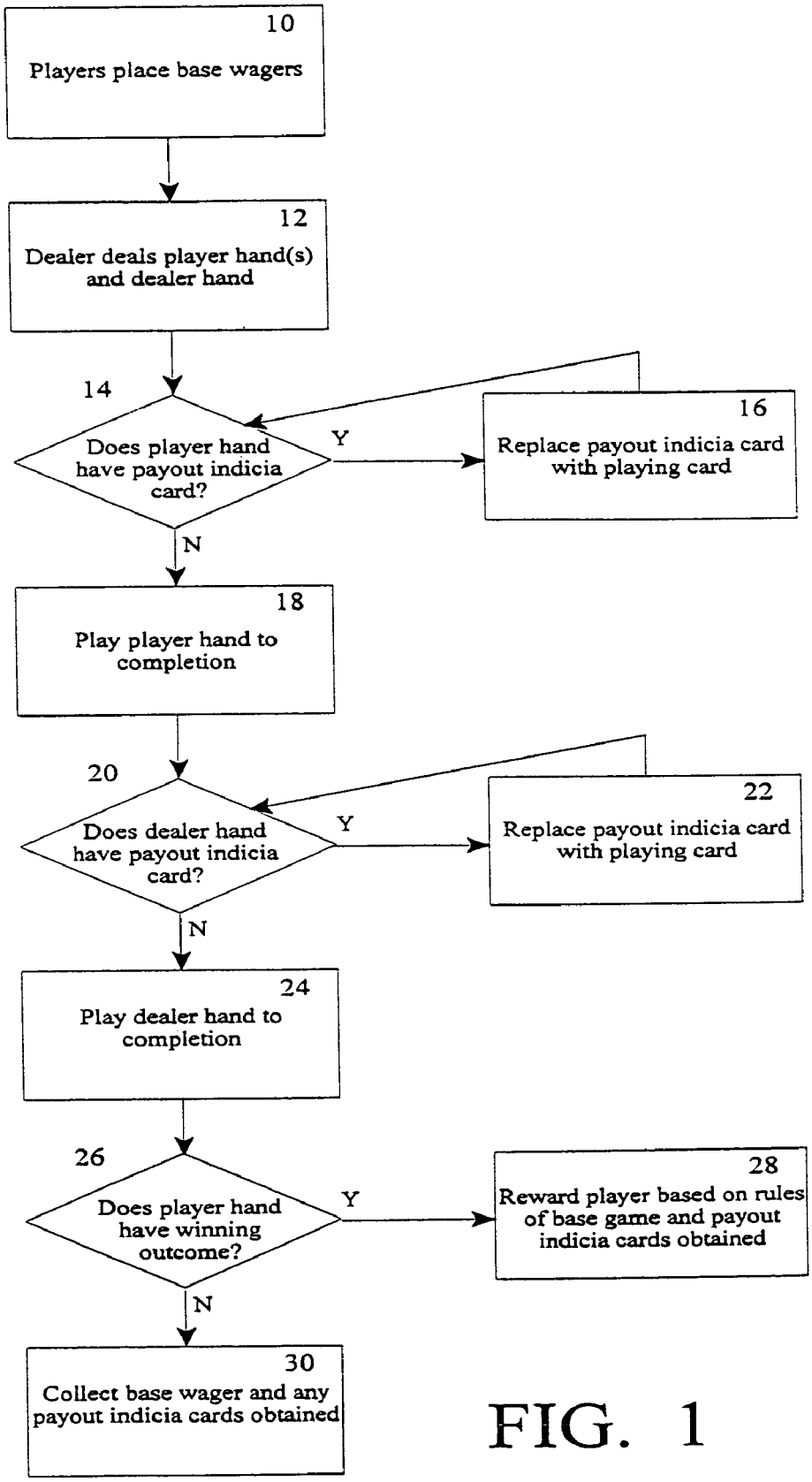
FIG. 1 is a flowchart of a method according to an optional embodiment of the present invention.

Reference is now made to the figures wherein like parts are referred to by like numerals throughout. The game method of the present invention is intended for a base game of the type utilizing playing cards or electronic representations thereof. For example, it is contemplated that the present invention may be suited for use in conjunction with such base games as Blackjack, Spanish 21, Baccarat, or any other card game in either table game form or electronic, mechanical, electromechanical, or video form.

The present game method is played between a dealer and at least one player. Referring first to "live" versions of the present game method utilizing playing cards, prior to beginning the game, one or more indicia cards are randomly located among the playing cards for the base game. For example, in an optional embodiment in which Blackjack is the base game, one or more indicia cards are inserted into a deck of conventional playing cards or a shoe of multiple decks of conventional playing cards. Of course, the ratio of indicia cards to playing cards relates directly to the frequency with which the indicia cards will be dealt to players during game play. Thus, the occurrence of indicia cards being dealt can be altered by simply increasing or decreasing the ratio of indicia cards to playing cards utilized in the base game.

In an optional embodiment, the indicia cards have conventional card backs and are oriented among the playing cards to make the indicia cards indiscernible from the ordinary playing cards. In another optional embodiment, the indicia cards include an indicia on the card front and on all or a portion of the card back. For example, an indicia card could optionally include front with an indicia and a back with a design around its perimeter and a replica of the indicia in the center. Similarly, an indicia card could optionally include an indicia on its front and back.

As with the appearance of the indicia card, the form and function of the faces of the indicia cards could vary widely. Broadly speaking, indicia cards could take the form of a payout indicia card, the purpose of which is to randomly alter payouts during game play, and an outcome indicia card, the purpose of which is to randomly change the outcome of any player hand. These random alterations could take many forms including increasing the potential payout for winning hands during game play of the base game and/or changing losing outcomes to push outcomes. For example, in one optional embodiment, a player receiving a payout indicia card who obtains a winning outcome during play of that particular hand is awarded at the rate indicated on the payout indicia card. Similarly, in another optional embodiment, a player receiving an outcome indicia card who obtains a losing outcome during play of that particular hand retains his base wager rather than losing.

In an optional embodiment of the present method, the indicia cards do not have a playing card value toward play of the base game but merely serve to indicate the change in outcome or payout from the payout or outcome dictated by the base rules. That is, in an optional embodiment, indicia cards cannot be utilized to improve a player's hand—only to alter the payout or outcome.

It is contemplated that the payout indicia cards could indicate any payout, payout multiplier, or multiple player payout. Similarly it is contemplated that outcome indicia cards could indicate any winning, losing, or push outcome. Although there is no set form for the indicia cards, a number of possible examples can be envisioned. The inclusion of these possible forms of the indicia cards should be seen as exemplary rather than limiting. It is further noted that it is contemplated that the different types of indicia cards could be used in any combination with one another.

In one optional embodiment, payout indicia cards serve to multiply the payout for a winning hand. For example, payout indicia cards could state that winning awards are doubled, tripled, quadrupled, quintupled, and so forth. In such an embodiment, a player winning the base game will awarded according to the rules of the base game unless he or she also has a payout indicia card, in which case the award is multiplied as indicated by the payout indicia card.

In another optional embodiment of the present invention, the payout indicia card could include a fixed reward for a winning hand. For example, the payout indicia cards could state that winning hands are rewarded at $150.00 or any other fixed amount. In such an embodiment, a player winning the base game is rewarded according to the rules of the base game unless he or she also has a payout indicia card, in which case the player is rewarded at the fixed rate indicated on the payout indicia card without regard to the amount wagered.

In yet another optional embodiment, the payout indicia card may apply to all players with winning wagers and not just the player who obtained the payout indicia card. For example, a payout indicia card could read "Double All Players' Winning Awards." In such an embodiment, all active players with winning hands participating in a game would be eligible to be rewarded at the increased rate without regard to which of the active players received the payout indicia card. In a further optional embodiment, players would be eligible to be rewarded at the increased rate even if the dealer received the payout indicia card.

Similarly, in one form of an outcome indicia card, a push card may be provided. Such a "Push" outcome indicia card may have the effect of changing a losing outcome to a push outcome for a player holding the outcome indicia card. For example, a player receiving a "Push" card during play of a hand would push, i.e. neither lose nor win his or her base wager, if the player loses the hand.

Turning now to embodiments utilizing electronic representations of playing cards, it is contemplated that the random inclusion of the indicia cards could take many forms. As can be appreciated, most such games include common components such as displays for displaying cards or simulations of cards and processors including data storage structure and a random number generator for conducting game play. In one embodiment, playing cards and indicia cards are randomized by the processor and displayed at the displays.

In another electronic form of the present method, a processor randomly selects the occurrence and value and type of the indicia cards based on such external parameters as number of total hands played. In such an embodiment, the occurrence rate parameter is set. At the outset, a random number generator selects the occurrence number within the occurrence rate parameter as well as the indicia card to be dealt. As hands are played, a running count is maintained by the processor when the number of hands played matches the occurrence number randomly selected by the random number generator, the indicia card is dealt and displayed. The process then repeats for the next occurrence of a indicia card.

In yet another electronic embodiment, similar to the preceding embodiment, the processor tracks the total number of losing hands rather than the total number of player hands overall. Thus, the indicia card is dealt and displayed when the occurrence number, as randomly selected between the set parameters in the same manner as the preceding embodiment, matches the running total of losing hands.

Turning now to play of the game itself, reference is made to the flowchart of FIG. 1. According to the method of the present invention, game play begins in the same manner as the base game. Thus, in a Blackjack embodiment of the method, each player makes a base wager 10 and hands are dealt 12 to each player and the dealer. Players not receiving an indicia card proceed with game play according to the rules of the base game and play 18 the player hand to completion. Thus, in Blackjack, players without indicia cards hit, stand, split, or double down as desired to obtain a final hand.

Conversely, players obtaining 14 an indicia card conduct play in a slightly altered manner. First, the indicia card has no playing card value and, thus, must be replaced 16 with a playing card. Thus, in Blackjack, an indicia card would be removed from a player hand and replaced. In an optional embodiment, the indicia card is placed face up on the playing surface. The player then forms 18 a final hand by hitting or standing as desired. If the player busts, the dealer collects the player's wager and the indicia card. Although it is theoretically possible to "carry over" indicia cards in other embodiments, in the present contemplated embodiment, indicia cards are only usable for a single hand.

If during play of a hand, the player receives more than one indicia card, the house rules may dictate whether only one indicia card will be honored or whether the indicia cards will be cumulative or multiplicative, as the case may be. For example, in one optional embodiment, a player who wins a base game while holding two "Double" payout indicia cards may be rewarded for winning the base game as well as an additional payout matching the base wager for each "Double" card held, for a total of two additional payouts. Similarly, in one optional embodiment, a player obtaining a "$100.00" and a "150.00" payout indicia card would be rewarded $250.00 in addition to being rewarded on his or her base wager if the player wins the base game.

In a game, such as Blackjack, in which splits and double downs are allowed, special rules may be made. While such rules could take many forms, in one optional embodiment, the effect of indicia cards is determined by the point during game play at which the indicia card is dealt. Thus, for splits, only the active hand is rewarded according to the indicia card. For example, if the indicia card is dealt prior to a player choosing to split, i.e. the indicia card was among the player's initial hand, or after choosing to split while the player is playing the first split hand, then the indicia card will only affect the wager for the first split hand. If the indicia card is dealt while the player is playing the second split hand, the indicia card only affects the wager for the second split hand.

Similarly, in the case of a double down, the sequence in which the indicia card is dealt determines the wager that is affected by the indicia card. If the indicia card is among the player's initial hand, i.e. among the first or second card dealt to a player, and prior to the determination to "double down", then the award card applies to the base wager with the first bet. If the award card was dealt after the double down has been selected and the additional wager has been made, then the indicia card applies to the entire doubled wager.

After each player has played his or her hand to completion, the dealer plays 24 his or her hand. Play by the dealer proceeds according to the rules of the base game unless the dealer receives an indicia card. If the dealer receives 20 an indicia card, the indicia card must be replaced 22 with a playing card because, as indicated previously, the indicia cards have no value in play of the base game. It is contemplated that the indicia cards dealt to the dealer may be given effect or discarded by the dealer depending on the house rules. It is also contemplated that different cards may be handled differently by the dealer. For example, in one optional embodiment, the dealer may discard payout indicia cards that are single hand multipliers or single hand fixed rewards but may give effect to cards rewarding all players with winning hands.

After removing any indicia cards from the dealer hand, the dealer plays 24 the dealer hand to completion. The dealer determines 26 whether any players have winning outcomes and rewards 28 winning wagers, taking into account any payout indicia cards held by that player or dealt to any player with game-wide effect and any outcome indicia cards that may alter the outcome of players hands. For example, in an optional embodiment including "Push" cards, players holding a "Push" outcome indicia card with losing outcomes, i.e. in Blackjack player hands that bust or are further from twenty-one than the dealer hand, may be entitled to retain their base wagers. The dealer collects 30 losing wagers as well as all playing cards and indicia cards dealt during game play.

An alternate embodiment is also envisioned in which players must place a side wager to be entitled to the use of indicia cards. In the method of this embodiment, players place a base wager and a side wager. Play continues substantially like that of the preceding embodiment. However, in paying wagers, several optional methods could be applied.

In one optional embodiment, the side wager is lost if no indicia card is dealt that applies to the player; that is a indicia card that is dealt to that player or dealt to any player or dealer with game-wide effect. If the player has a winning outcome and receives an indicia card, both the base wager and the side wager are rewarded as indicated on the indicia card. If the player loses, both wagers are collected. In a variation on this embodiment, it is contemplated that for players having a winning outcome and an indicia card, the base wager is rewarded according to the base game and only the side wager is rewarded as indicated on the indicia card.

In yet another embodiment of the present method, it is contemplated that a player with a losing outcome who places a side wager and receives an indicia card may be rewarded on the side wager and lose the base wager. In an optional variation on the preceding embodiment, a player placing a side wager who receives an indicia card but receives a losing outcome may push on both the side wager and the base wager.

While certain embodiments of the present invention have been shown and described it is to be understood that the present invention is subject to many modifications and changes without departing from the spirit and scope of the claims presented herein.

What is claimed is:

1. A method for conducting a base game for at least one player utilizing cards or electronic representations of cards, the base game played according to base rules, comprising:

randomly including among the cards at least one indicia card with no value in the base game wherein the indicia card is a payout indicia card and the step of resolving wagers includes rewarding each player who receives a payout indicia card according to the payout indicated on the payout indicia card rather than the base rules;

each player making a wager;

each player receiving a hand of cards;

playing the base game according to the base rules;

if during play of the base game, a player receives an indicia card in the player's hand of cards, replacing the indicia card;

determining whether each player's hand of cards is a winning hand, a losing hand, or a push hand;

if a player receives one indicia card, resolving the player's wager according to the indicia card rather than the base rules; and if a player receives more than one indicia card, resolving the player's wager according to a rule selected from the group consisting of:

only rewarding the player according to the payout indicia card that results in the highest payout; and rewarding the player according to the combination of payout indicia cards.

2. The method of claim 1 further comprising players having an option to place a side wager such that players are only being eligible to have a wager resolved according to an indicia card rather than the base rules if player places a side wager and receives an indicia card.

3. A method for conducting a base game for at least one player utilizing cards or electronic representations of cards, the base game played according to base rules, comprising:

randomly including among the cards at least one outcome indicia card with no value in the base game;

randomly including among the cards a payout indicia card with no value in the base game;

each player making a wager;

each player receiving a hand of cards;

playing the base game according to the base rules;

if during play of the base game, a player receives an outcome indicia card in the player's hand of cards, replacing the outcome indicia card;

resolving each player's wager by determining whether each player's hand of cards is a winning hand, a losing hand, or a push hand;

changing the outcome for a player who receives an outcome indicia card according to the outcome indicated on the outcome indicia card rather than the outcome under the base rules; and rewarding each player who receives a payout indicia card according to the payout indicated on the payout indicia card rather than the base rules, whereby such payouts are controlled by a rule selected from:

if any player receives a payout indicia card, rewarding all players of the base game according to the payout indicated on the payout indicia card rather than the base rules;

if any player receives a payout indicia card, rewarding all players of the base game who receive a winning hand according to the payout indicated on the payout indicia card rather than the base rules;

if any player receives a payout indicia card and has a winning hand, rewarding all players of the base game according to the payout indicated on the payout indicia card rather than the base rules; and if any player receives a payout indicia card and has a winning hand, rewarding all players of the base game who receive a winning hand according to the payout indicated on the payout indicia card rather than the base rules.

4. A method for conducting a base game for at least one player utilizing cards or electronic representations of cards, the base game played according to base rules, comprising:

randomly including among the cards at least one outcome indicia card with no value in the base game;

each player making a wager;

each player receiving a hand of cards;

playing the base game according to the base rules;

if during play of the base game, a player receives an outcome indicia card in the player's hand of cards, replacing the outcome indicia card;

resolving each player's wager by determining whether each player's hand of cards is a winning hand, a losing hand, or a push hand; and changing the outcome for a player who receives an outcome indicia card according to the outcome indicated on the outcome indicia card rather than the outcome under the base rules, wherein a player with a losing hand who receives an outcome indicia card is rewarded in accordance with at least a push hand according to the outcome indicia card rather than a losing hand according to the base rules.

5. A method for conducting a base game for at least one player utilizing cards or electronic representations of cards, the base game played according to base rules, comprising:

randomly including among the cards at least one outcome indicia card with no value in the base game;

randomly including among the cards a payout indicia card with no value in the base game;

each player making a wager;

each player receiving a hand of cards;

playing the base game according to the base rules;

if during play of the base game, a player receives an outcome indicia card in the player's hand of cards, replacing the outcome indicia card;

resolving each player's wager by determining whether each player's hand of cards is a winning hand, a losing hand, or a push hand;

changing the outcome for a player who receives an outcome indicia card according to the outcome indicated on the outcome indicia card rather than the outcome under the base rules;

if a player receives one indicia card, resolving the player's wager according to the indicia card rather than the base rules; and if a player receives more than one payout indicia card resolving said player's wager according to a rule selected from the group consisting of:

only rewarding the player according to the payout indicia card that results in the highest payout; and rewarding the player according to the combination of payout indicia cards.

6. A method for conducting a base game for at least one player utilizing cards or electronic representations of cards, the base game played according to base rules, comprising:

randomly including among the cards at least one payout indicia card with no value in the base game;

each player making a wager;

each player receiving a hand of cards;

playing the base game according to the base rules;

if during play of the base game, a player receives a payout indicia card in the player's hand of cards, replacing the payout indicia card;

resolving each player's wager by determining whether each player's hand of cards is a winning hand or a losing hand; and rewarding each player who receives a payout indicia card according to the payout indicated on the payout indicia card rather than the base rules whereby such payouts are controlled by a rule selected from:

if any player receives a payout indicia card, rewarding all players of the base game according to the payout indicated on the payout indicia card rather than the base rules;

if any player receives a payout indicia card, rewarding all players of the base game who receives a winning hand according to the payout indicated on the payout indicia card rather than the base rules;

if any player receives a payout indicia card and has a winning hand, rewarding all players of the base game according to the payout indicated on the payout indicia card rather than the base rules; and if any player receives a payout indicia card and has a winning hand, rewarding all players of the base game who receives a winning hand according to the payout indicated on the payout indicia card rather than the base rules.

7. The method of claim 6 further comprising:

randomly including among the cards an outcome indicia card with no value in the base game;

if during play of the base game, a player receives an outcome indicia card in the player's hand of cards, replacing the outcome indicia card; and changing the outcome for a player who received an outcome indicia card according to the outcome indicated on the outcome indicia card rather than the outcome under the base rules.

8. A method for conducting a base game for at least one player utilizing cards or electronic representations of cards, the base game played according to base rules, comprising:

randomly including among the cards at least one payout indicia card with no value in the base game;

randomly including among the cards an outcome indicia card with no value in the base game;

each player making a wager;

each player receiving a hand of cards;

playing the base game according to the base rules;

if during play of the base game, a player receives a payout indicia card in the player's hand of cards, replacing the payout indicia card;

if during play of the base game, a player receives an outcome indicia card in the player's hand of cards, replacing the outcome indicia card;

changing the outcome for a player who receives an outcome indicia card according to the outcome indicated on the outcome indicia card rather than the outcome under the base rules wherein a player with a losing hand who receives an outcome indicia card is rewarded in accordance with at least a push hand according to the outcome indicia card rather than a losing hand according to the base rules;

resolving each player's wager by determining whether each player's hand of cards is a winning hand or a losing hand; and rewarding each player who receives a payout indicia card according to the payout indicated on the payout indicia card rather than the base rules.

9. A method for conducting a base game for at least one player utilizing cards or electronic representations of cards, the base game played according to base rules, comprising:

randomly including among the cards at least one payout indicia card with no value in the base game;

randomly including among the cards an outcome indicia card with no value in the base game;

each player making a wager;

each player receiving a hand of cards;

playing the base game according to the base rules;

if during play of the base game, a player receives a payout indicia card in the player's hand of cards, replacing the payout indicia card;

if during play of the base game, a player receives an outcome indicia card in the player's hand of cards, replacing the outcome indicia card;

changing the outcome for a player who receives an outcome indicia card according to the outcome indicated on the outcome indicia card rather than the outcome under the base rules;

resolving each player's wager by determining whether each player's hand of cards is a winning hand or a losing hand;

rewarding each player who receives one payout indicia card according to the payout indicated on the payout indicia card rather than the base rules; and rewarding each player who receives more than one payout indicia card according to a rule selected from the group consisting of:

only rewarding the player according to the payout indicia card that results in the highest payout; and rewarding the player according to the combination of payout indicia cards.

* * * * *